US007568351B2

(12) United States Patent
Xu et al.

(10) Patent No.: US 7,568,351 B2
(45) **Date of Patent: *Aug. 4, 2009**

(54) MULTI-STAGE PULSE TUBE WITH MATCHED TEMPERATURE PROFILES

(75) Inventors: Mingyao Xu, Emmaus, PA (US); Jin Lin Gao, Shanghai (CN)

(73) Assignees: SHI-APD Cryogenics, Inc., Allentown, PA (US); Sumitomo Heavy Industries, Ltd., Tokyo (JP)

( * ) Notice: Subject to any disclaimer, the term of this patent is extended or adjusted under 35 U.S.C. 154(b) by 316 days.

This patent is subject to a terminal disclaimer.

(21) Appl. No.: 11/333,760

(22) Filed: Jan. 17, 2006

(65) Prior Publication Data

US 2006/0174635 A1 Aug. 10, 2006

Related U.S. Application Data

(60) Provisional application No. 60/650,286, filed on Feb. 4, 2005.

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 2,782,465 | A * | 2/1957 | Palmer, Jr. | 52/309.15 |
| 3,119,237 | A | 1/1964 | Gifford | |
| 3,237,421 | A | 3/1966 | Gifford | |
| 4,192,352 | A * | 3/1980 | Hakamada et al. | 138/149 |
| 4,293,607 | A * | 10/1981 | Millgardh et al. | 428/212 |
| 4,484,458 | A | 11/1984 | Longsworth | |
| 4,606,201 | A | 8/1986 | Longsworth | |
| 5,107,683 | A | 4/1992 | Chan et al. | |
| 5,295,355 | A | 3/1994 | Zhou et al. | |
| 5,412,952 | A | 5/1995 | Ohtani et al. | |
| 5,522,223 | A * | 6/1996 | Yanai et al. | 62/6 |
| 5,613,365 | A | 3/1997 | Mastrup et al. | |
| 5,680,768 | A | 10/1997 | Rattray et al. | |
| 6,256,998 | B1 * | 7/2001 | Gao | 62/6 |
| 6,378,312 | B1 * | 4/2002 | Wang | 62/6 |
| 6,619,046 | B1 | 9/2003 | Mitchell | |

(Continued)

FOREIGN PATENT DOCUMENTS

| | | |
|---|---|---|
| CN | 1519518 | 8/2004 |

(Continued)

OTHER PUBLICATIONS

E.I. Mikulin et al. "Low-Temperature Expansion Pulse Tubes" Advances in Cryogenic Engineering, vol. 29, p. 629-637, 1984.

(Continued)

*Primary Examiner*—William C Doerrler
(74) *Attorney, Agent, or Firm*—Katten Muchin Rosenman LLP

(57) ABSTRACT

Convection losses associated with different temperature profiles in the pulse tubes and regenerators of multi-stage pulse tubes mounted in helium gas in the neck tube of a MRI cryostat are reduced by providing one or more of thermal bridges, and/or insulating sleeves between one or more pulse tubes and regenerators, and/or spacers, and spacer tubes, in one or more pulse tubes and regenerators.

22 Claims, 14 Drawing Sheets

U.S. PATENT DOCUMENTS

| | | | | |
|---|---|---|---|---|
| 7,047,750 | B2 | 5/2006 | Mita et al. | |
| 7,131,276 | B2 | 11/2006 | Pan et al. | |
| 7,173,046 | B2 | 2/2007 | Zheng et al. | |
| 2003/0163996 | A1* | 9/2003 | Ravex | 62/6 |
| 2004/0112065 | A1* | 6/2004 | Pan et al. | 62/6 |
| 2005/0044860 | A1 | 3/2005 | Mita et al. | |
| 2005/0274124 | A1* | 12/2005 | Wang | 62/6 |
| 2006/0144054 | A1* | 7/2006 | Xu et al. | 62/6 |
| 2006/0242968 | A1* | 11/2006 | Mita et al. | 62/6 |

FOREIGN PATENT DOCUMENTS

| | | |
|---|---|---|
| EP | 1418388 | 5/2004 |
| JP | 7-260269 | 10/1995 |
| JP | 2001-248927 | 9/2001 |
| JP | 2001-263841 | 9/2001 |
| JP | 2001-272126 | 10/2001 |
| JP | 2003-75001 | 3/2003 |
| JP | 2003-532045 | 10/2003 |
| JP | 2004-286430 | 10/2004 |
| WO | WO 03/036190 | 5/2003 |
| WO | WO 03/036207 | 5/2003 |

OTHER PUBLICATIONS

R.C. Longsworth "Early Pulse Tube Refrigerator Developments", Cryocoolers 9, p. 261-268, 1997.

S. Zhu et al. "Double Inlet Pulse Tube Refrigerators: An Important Improvement" Cryogenics, vol. 30, p. 514, 1990.

Y. Matsubara et al. "An Experimental and Analytical Investigation of 4 K Pulse Tube Refrigerator" Proc. 7, Intl Cryocooler Conf., Air Force Report PL-(P-93-101), p. 166-186, 1993.

J.L. Gao et al. "Experimental Investigation of 4 K Pulse Tube Refrigerator" Cryogenics, vol. 34, p. 25, 1994.

L.W. Yang et al. "Research of Two-Stage Co-Axial Pulse Tube Coolers Driven by a Valveless Compressor" Cryocoolers 10, p. 233-238, 1999.

K. Yuan et al. "Experimental Investigation of a G-M Type Coaxial Pulse Tube Cryocooler", Cryocoolers 12, p. 317-323, 2001.

Chinese Office Action dated Aug. 8, 2008, from the corresponding Chinese Application.

Japanese Office Action dated Jul. 22, 2008, from the corresponding Japanese Application.

Decision of Refusal dated Mar. 17, 2009, from the corresponding Japanese Application.

* cited by examiner

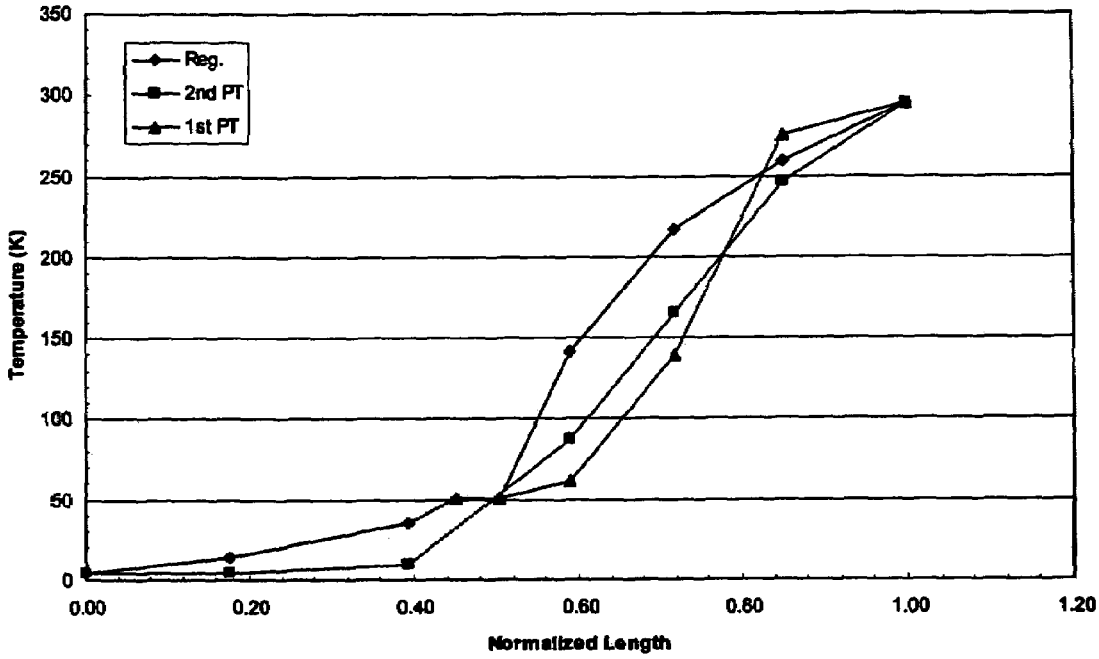
Fig. 2a Temperature profile in a two-stage 4 K pulse tube in vacuum
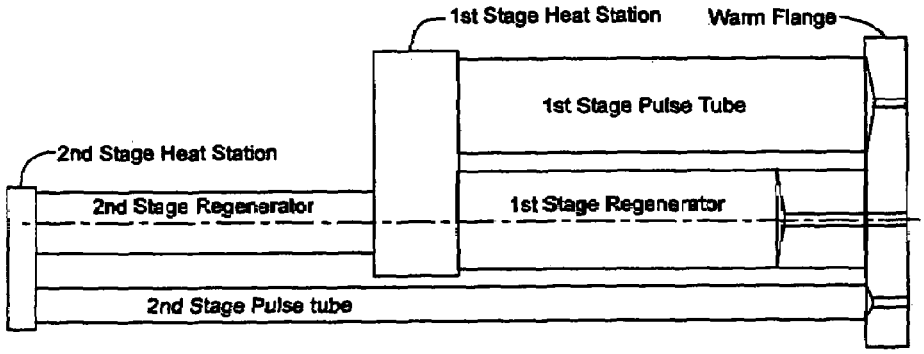
Fig. 2b Conventional two-stage 4 K pulse tube

MULTI-STAGE PULSE TUBE WITH MATCHED TEMPERATURE PROFILES

CROSS REFERENCE TO RELATED APPLICATION

This application claims priority from U.S. Provisional Application 60/650,286, filed Feb. 4, 2005, the contents of which are herein wholly incorporated by reference.

BACKGROUND OF THE INVENTION

The present invention relates to multi-stage Gifford McMahon (GM) type pulse tube refrigerators as applied to recondensing helium in a MRI magnet. When a conventional multi-stage pulse tube is operated in the neck tube of a MRI cryostat, where it is surrounded by helium, significant thermal losses can occur due to convective circulation of the helium because of differences of the temperature profiles in the pulse tubes and the regenerators.

GM type refrigerators use compressors that supply gas at a nearly constant high pressure and receive gas at a nearly constant low pressure to an expander. The expander runs at a low speed relative to the compressor by virtue of a valve mechanism that alternately lets gas in and out of the expander. Gifford, U.S. Pat. No. 3,119,237, describes a version of a GM expander with a pneumatic drive. The GM cycle has proven to be the best means of producing a small amount of cooling below about 20 K because the expander can run at 1 to 2 Hz.

A Pulse Tube refrigerator was first described by Gifford in U.S. Pat. No. 3,237,421, which shows a pair of valves, as in the earlier GM refrigerators, connected to the warm end of a regenerator, which in turn is connected at the cold end to a pulse tube. Early work with pulse tube refrigerators in the mid 1960s is described in a paper by R. C. Longsworth '*Early pulse tube refrigerator developments*, Cryocoolers 9, 1997, p. 261-268. Single-stage, two-stage, four stage with inter-phasing, and co-axial designs were studied. All had the warm ends of the pulse tube closed and all but the co-axial design had the pulse tubes separate from the regenerators. While cryogenic temperatures were achieved with these early pulse tubes the efficiency was not good enough to compete with GM type refrigerators.

A significant improvement in pulse tube performance was reported by Mikulin et al, '*Low temperature expansion (orifice type) pulse tube*, Advances in Cryogenic Engineering, Vol. 29, 1984, p. 629-637, and much interest ensued in looking for further improvements. This initial improvement used an orifice and a buffer volume connected to the warm end of the pulse tube to control the motion of the "gas piston" in the pulse tube to produce more cooling each cycle.

Subsequent work focused on both means to improve the control of the gas piston and on improving the configuration of the pulse tube expander. S. Zhu and P. Wu, in a paper titled '*Double inlet pulse tube refrigerators: an important improvement*', Cryogenics, vol. 30, 1990, p. 514, describe a double orifice means of controlling the gas piston. Gao, U.S. Pat. No. 6,256,998 describes a means of controlling the gas pistons in a two-stage pulse tube that works well at 4 K.

Multi-stage pulse tubes were first investigated by Gifford and Lonsworth '*Early pulse tube refrigerator developments*', Cryocoolers 9, 1997, p. 261-268 using a design that pumped heat from one stage to the next higher stage. Chan et al. found that it is possible, and better, to have the second stage pulse tube extend all the way from the cold heat exchanger to ambient temperature as described in U.S. Pat. No. 5,107,683.

This concept is one of several configurations reported by Y. Matsubara, J. L. Gao, K. Tanida, Y. Hiresaki and M. Kaneko, '*An experimental and analytical investigation of 4K (four valve) pulse tube refrigerator*', Proc. 7' Intl Cryocooler Conf., Air Force Report PL-(P-93-101), 1993, p. 166-186, and by J. L. Gao and Y. Matsubara, '*Experimental investigation of 4 K pulse tube refrigerator*', Cryogenics 1994, Vol. 34, p. 25. It has proven to work well for two-stage 4 K pulse tubes. The arrangements that were studied all had the pulse tubes separate from the regenerators and parallel to them, with the cold end oriented down. This is the most common configuration of present day two-stage pulse tubes and is referred to herein as the conventional design. U.S. Pat. No. 5,412,952, Ohtani et al., shows a two-stage pulse tube with a thermal link between the first stage heat station and the adjacent second stage pulse tube. One of the present inventors tested this configuration in 1994 and found no improvement in cooling performance, but it did cause a change in the pulse tube temperature profile.

Temperature differences between the pulse tubes and the regenerators are not a problem when the tubes are separate from the regenerator and the pulse tube is surrounded by vacuum. The temperature differences however result in convective thermal losses when a conventional pulse tube is mounted in the helium atmosphere in the neck tube of a MRI cryostat.

Losses associated with temperature differences between the pulse tube and regenerator were addressed in connection with co-axial pulse tubes by Inoue in JP H07-260269. This patent shows several porous plug heat exchangers spaced inside the pulse tubes near the warm end and in contact with the walls of the first stage regenerator. U.S. Pat. No. 5,613,365, Mastrup et al., describes a single stage concentric (co-axial) pulse tube in which a central pulse tube has a thick wall made of low thermal conductivity material that provides a high degree of insulation from the annular regenerator on the outside. Rattay et al. extended this idea in U.S. Pat. No. 5,680,768, in which the surrounding vacuum extends into a gap between the pulse tube wall and the inner wall of the regenerator.

Another means of insulating the wall of a pulse tube is described by Mitchell, U.S. Pat. No. 6,619,046. Studies of losses in co-axial pulse tubes are reported in papers by L. W. Yang, J. T. Liang, Y. Zhou, and J. J. Wang. '*Research of two-stage co-axial pulse tube coolers driven by a valveless compressor*, Cryocoolers 10, 1999, p. 233-238, and by K. Yuan, J. T. Liang, and Y. L. Ju, '*Experimental investigation of a G-M type co-axial pulse tube cryocooler*", Cryocoolers 12, 2001, p. 317-323. Losses were minimized by superimposing "dc" flow that brought warm gas down the pulse tubes over many cycles.

Zhou et al., U.S. Pat. No. 5,295,355, describe a multi-bypass pulse tube that has as its objective an improvement in efficiency. In effect it is a multi-stage pulse tube but there is only one pulse tube. In practice it is nearly impossible to implement because of the difficulty of having the exact same amount of gas flow in both directions through each by-pass orifice. It does have the characteristic of imposing essentially the same temperature profile in the pulse tube as the regenerator.

Problems associated with recondensing helium in a MRI magnet were addressed by Longsworth in U.S. Pat. No. 4,606,201. A two-stage GM expander that has a minimum temperature of 10 K precools gas in a JT heat exchanger that produces cooling at 4 K. The JT heat exchanger is coiled around the GM expander so that the temperature of both the JT heat exchanger and the expander get progressively colder between the warm and cold ends. The expander assembly is mounted in the neck tube of a MRI magnet where it is surrounded by helium gas that is thermally stratified by virtue of being vertically oriented with the cold end down. The 4 K heat station has an extended surface to recondense He. Refrigeration is transferred to cold shields in the MRI cryostat at two heat stations which are at temperatures of approximately 60 K and 15 K. Mating conical heat stations and bellows in the neck tube enable both heat stations to engage as the warm flange is bolted down and sealed with a face type "O" ring.

Longsworth, U.S. Pat. No. 4,484,458, had previously described the concentric GM/JT expander which had straight heat stations and a radial type "O" ring seal at the warm flange. This permits the expander to be moved axially to establish a desired position of the expander heat stations relative to the neck tube heat stations.

Advances in pulse tube technology and MRI cryostat design now make it possible to use a two stage pulse tube to cool a single shield at about 40 K and recondense helium at about 4 K. Two-stage pulse tube expanders are preferred over two-stage GM expanders because they have less vibration and thus generate less noise in the MRI signal. When a pulse tube of the current design, with the pulse tubes parallel to the regenerators, is inserted into the neck tube of a MRI magnet it is found that helium gas in the neck tube circulates between the pulse tubes and the regenerators due to the temperature differences between them. This results in a serious loss of refrigeration.

Stautner et al., PCT WO 03/036207 A2, explains the problem for a conventional two stage 4 K pulse tube and offers a solution in the form of a sleeve that surrounds the pulse tube assembly and has insulation packed around the tubes. The sleeve has a heat station at about 40 K and a recondenser at the cold end. It can be easily removed from the neck tube to be serviced.

Another solution to the problem of convection losses of a conventional two-stage 4 K pulse tube in a MRI neck tube is offered by Daniels et al. in PCT WO 03/036190 A1. Insulated sleeves around the pulse tubes and regenerators reduce convective losses when the pulse tube is mounted in the helium gas in a MRI neck tube.

A conventional two-stage pulse tube refrigerator has the pulse tubes and regenerators in separate parallel tubes. In conventional pulse tubes that operate in vacuum the length and diameter of the pulse tubes and regenerators can be optimized almost independently of each other. When mounted in the neck tube of a MRI cryostat the helium in the neck tube results in thermal losses due to convection because of the temperature differences between the pulse tubes and the regenerators, thus other factors have to be considered in the design.

It is an object of this invention to minimize heat loss by convection of a pulse tube when it operates in a helium environment.

SUMMARY OF THE INVENTION

The present invention reduces the convection losses associated with different temperature profiles in the pulse tubes and regenerators of multi-stage pulse tubes mounted in helium gas in the neck tube of a MRI cryostat by having one or more of thermal bridges, spacers, spacer tubes, and insulating sleeves between one or more pulse tubes and regenerators.

In a primary embodiment of the invention, it is used to recondense helium in a MRI cryostat by a two-stage GM type pulse tube. In an alternative embodiment, it is used to recondense hydrogen and neon in cryostats that are designed for High Temperature Superconducting, HTS, magnets. At the higher temperatures it is also practical to have the pulse tube be connected directly to a compressor and operate in a Stirling cycle mode at a much higher speed.

BRIEF DESCRIPTION OF THE DRAWINGS

FIG. 2*a* shows the temperature profiles that are typical for a conventional two-stage 4 K GM type pulse tube that is surrounded by vacuum while FIG. 2*b* is a schematic of the pulse tube to show the positions of the temperatures.

DETAILED DESCRIPTION OF THE INVENTION

Figure 1:
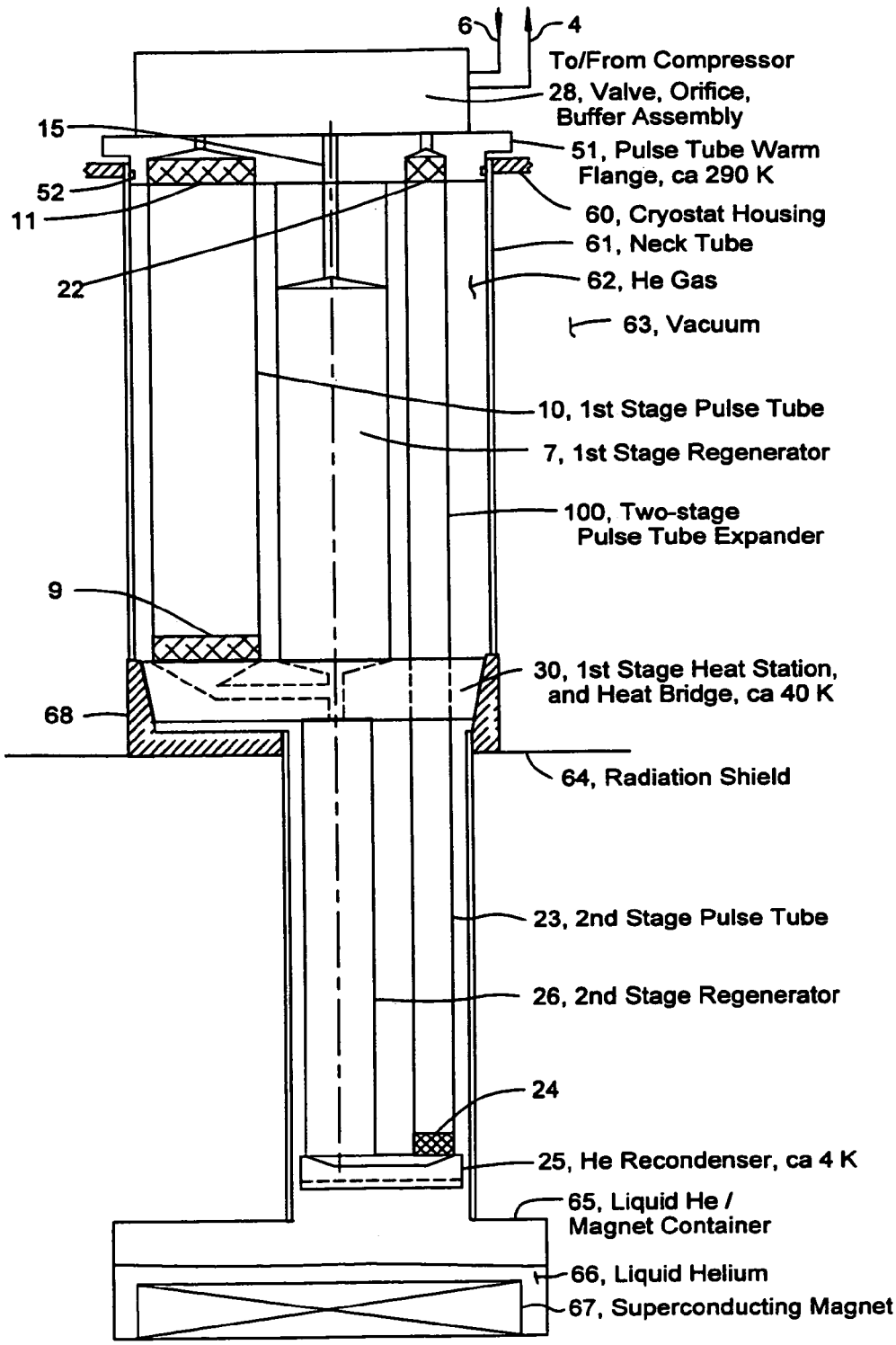
FIG. 1 is a schematic of the present invention which shows a two-stage pulse tube with a heat bridge at the first stage mounted in the neck tube of a MRI cryostat where it is surrounded by helium gas, has a heat station at about 40 K to cool a shield, and has a helium recondenser at about 4 K.

The modified design of the two stage pulse tube of the present invention, designed to operate other than in a vacuum, such as in a helium environment, permits the reduction of heat loss by convection. This pulse tube design provides a means to minimize thermal losses associated with mounting a two stage pulse tube in the neck tube of a liquid helium cooled MRI magnet. As shown in FIG. 1 two stage pulse tube 100, in accordance with the present invention, is inserted in neck tube 61 where it is surrounded by gaseous helium 62 that has a temperature gradient from room temperature, about 290 K, at the top to 4 K at the bottom. The pulse tube expander has a first stage heat station at about 40 K that is used to cool a shield in the magnet cryostat and a helium recondenser at the second stage. Having the pulse tube expander in the neck tube provides an easy way to remove it for service.

The MRI cryostat consists of an outer housing 60 that is connected to inner vessel 65 by neck tube 61. Vessel 65 contains liquid helium and superconducting MRI magnet 67. It is surrounded by vacuum 63. A typical MRI cryostat has a radiation shield 64 that is cooled to about 40 K through neck tube heat station 68 by the first stage of pulse tube expander 100. Expander 100 includes first stage pulse tube 10, first stage regenerator 7 which is packed in a tube, and second stage pulse tube 23, all of which are connected to warm flange 51. The three tubes are interconnected by first stage heat station 30 which acts as a thermal bridge between the heat transfer surface within 30 and second stage pulse tube 23. Within first stage pulse tube 10 is cold end flow smoother 9 and warm end flow smoother 11. Within second stage pulse tube 23 is cold end flow smoother 24 and warm end flow smoother 22. These flow smoothers may also function as heat exchangers. Gas flows through the cold end of second stage regenerator 26 to and from the cold end of second stage pulse tube 23 through heat transfer surface within helium recondenser 25. Warm flange 51 has gas port 15 from the warm end of regenerator 7 as well as ports connected to the warm ends of pulse tubes 10 and 23 which in turn connect to gas ports in orifice buffer volume assembly 28. Typically assembly 28 is connected to a valve mechanism which is connected to a compressor by supply gas line 6 and return gas line 4 to constitute a GM type pulse tube. It is also possible to connect assembly 28 directly to a compressor by a single gas line to constitute a Stirling type pulse tube.

Heat station 30 is shown as being conically shaped to mate with a similarly shaped receptacle in neck tube 61. Radial "O" ring 52 enables pulse tube 100 to be inserted into neck tube 61 until pulse tube heat station 30 is thermally engaged with neck tube heat station 68. It is typical to construct pulse tubes 1 and 2, and the shells for regenerators 3 and 4, from thin walled SS tubes to minimize axial conduction losses.

FIG. 2*a* shows the temperature profiles that are typical for a conventional two-stage 4 K GM type pulse tube, as shown in FIG. 2*b*, that is surrounded by vacuum. The temperature differences between the pulse tubes and the first stage regenerator are greater than the second stage temperature differences but the convection losses in a helium filled neck tube are more significant at the second stage than the first stage because the helium is a lot denser, thus the mass circulation rate is higher.

Figure 3:
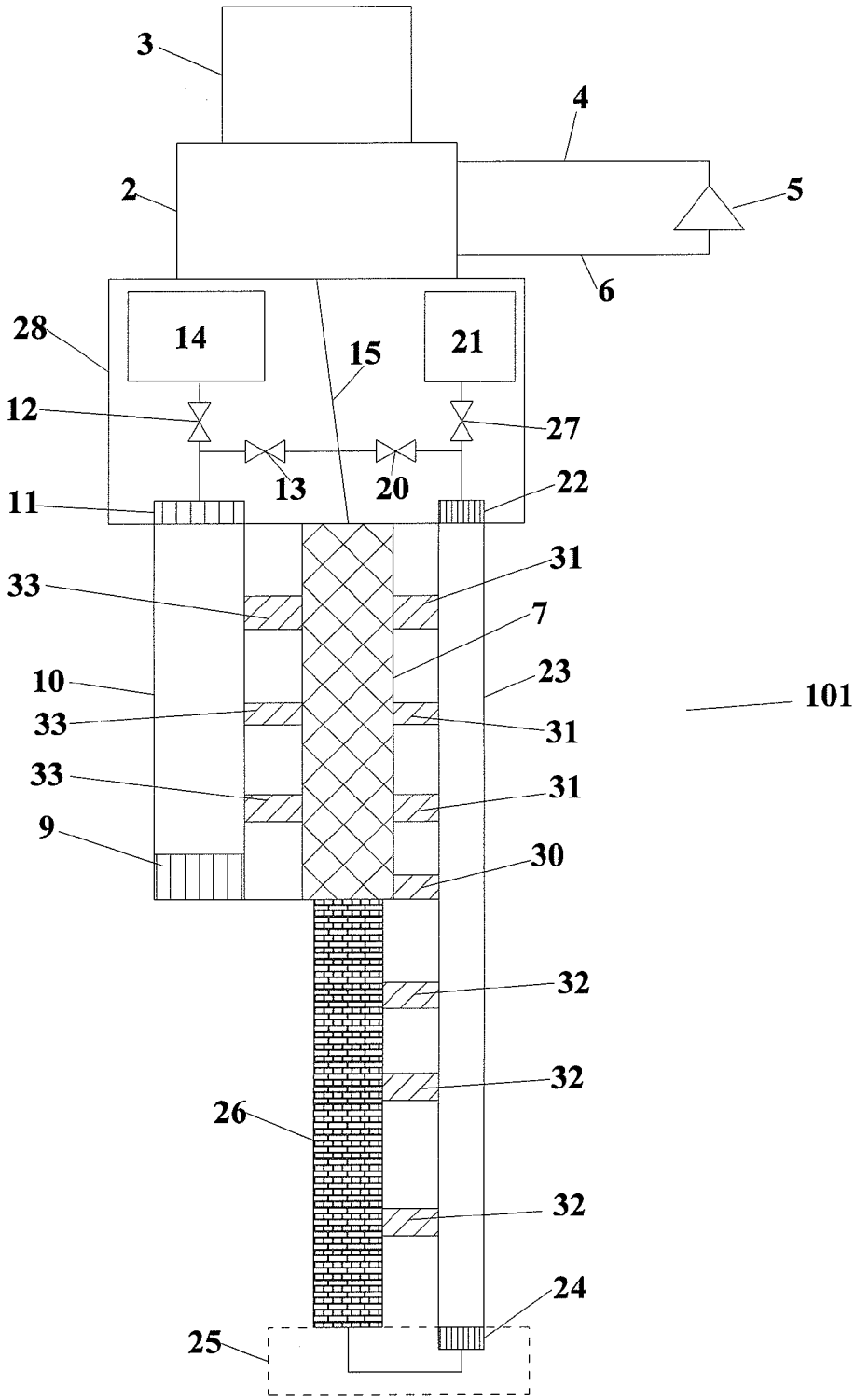
FIG. 3 is a schematic of a two-stage pulse tube in which thermal differences between the pulse tubes and regenerators are reduced by means of multiple thermal bridges.

FIG. 3 is a schematic of two stage pulse tube 101 in which thermal differences between the pulse tubes and regenerators are reduced by means of multiple thermal bridges. Thermal bridge 30 at the cold end of the first stage connects to second stage pulse tube 23 as described in connection with FIG. 1. Three thermal links 31 are shown between regenerator 7 and the upper part of pulse tube 23, three thermal links 33 are shown between regenerator 7 and pulse tube 10, and three thermal links 32 are shown between regenerator 26 and the lower part of pulse tube 23. The actual number of thermal links that are employed is a choice of the designer.

FIG. 3 shows schematically the typical components in orifice/buffer volume assembly 28. Double orifice control per S. Zhu and P. Wu, '*Double inlet pulse tube refrigerators: an important improvement*', Cryogenics, vol. 30, 1990, p. 514, is shown, consisting of orifices 13 and 20 that connect the cycling flow from the compressor through 15 to the warm ends of pulse tubes 10 and 23 respectively, orifice 12 that controls the flow rate of gas between pulse tube 10 and buffer volume 14, and orifice 27 that controls the flow rate of gas between pulse tube 23 and buffer volume 21. GM type flow cycling is shown with a valve mechanism in 2 driven by motor 3 and connected to compressor 5 by gas lines 4 and 6. Common components in FIGS. 1, and 3 through 14, have the same number identification.

Figure 4:
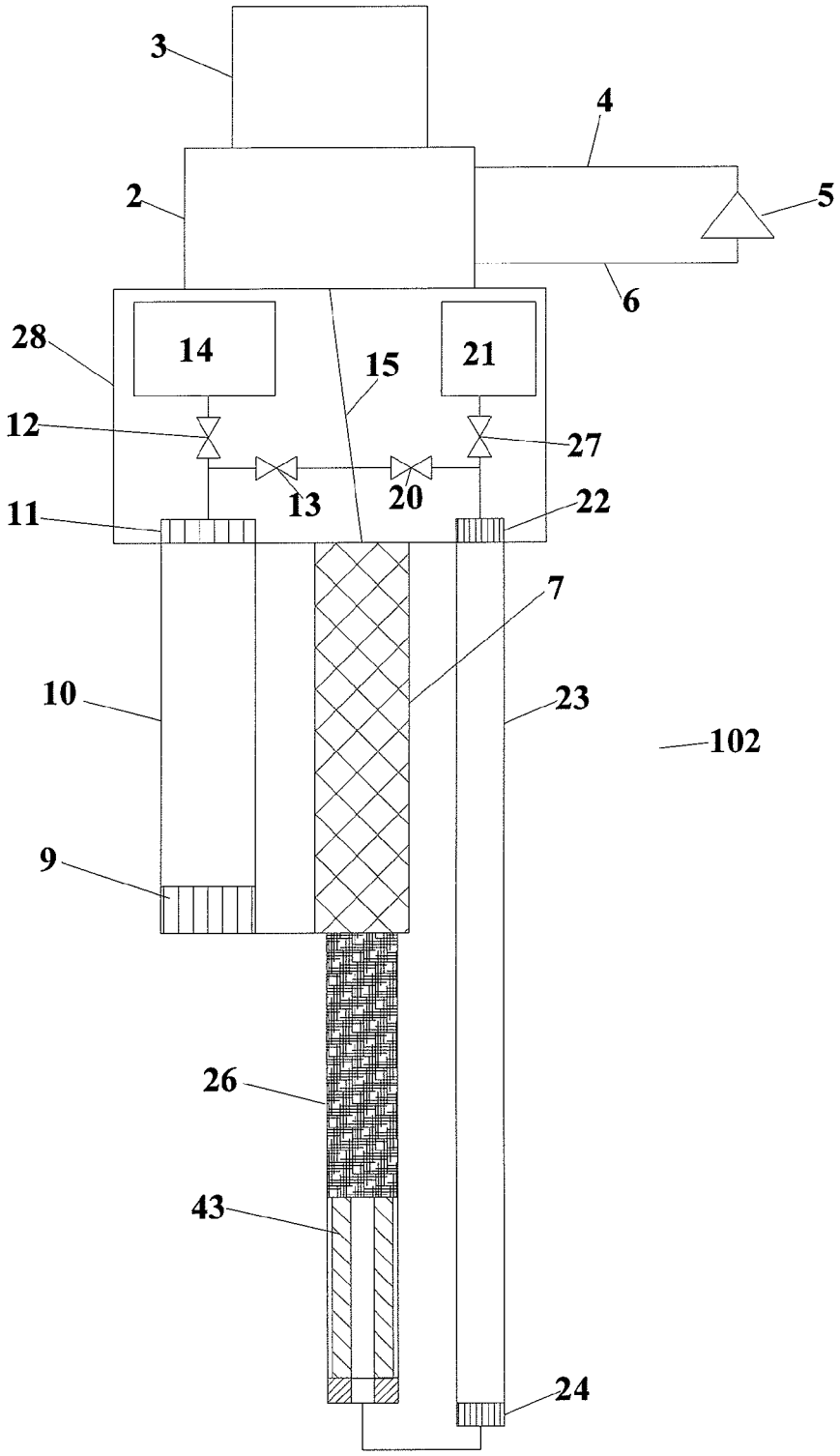
FIG. 4 is a schematic of a two-stage pulse tube in which thermal differences between the pulse tubes and regenerators are reduced by means of a spacer at the cold end of the second stage regenerator.

FIG. 4 shows two-stage pulse tube 102 in which thermal differences between the pulse tubes and regenerators are reduced by means of spacer 43 at the cold end of second stage regenerator 26. The length of spacer 43 is less than 20% the length of pulse tube 23, preferably between 5% and 20%. This distance is measured between the cold end of regenerator 26 and the top of flow smoother 24. All of the pulse tubes shown in FIGS. 3 through 13 have first stage heat station 30, and second stage heat station 25, as shown in FIGS. 1 and 14. Heat transfer surface in 25 can be augmented by heat transfer surface in spacer 43.

Figure 5:
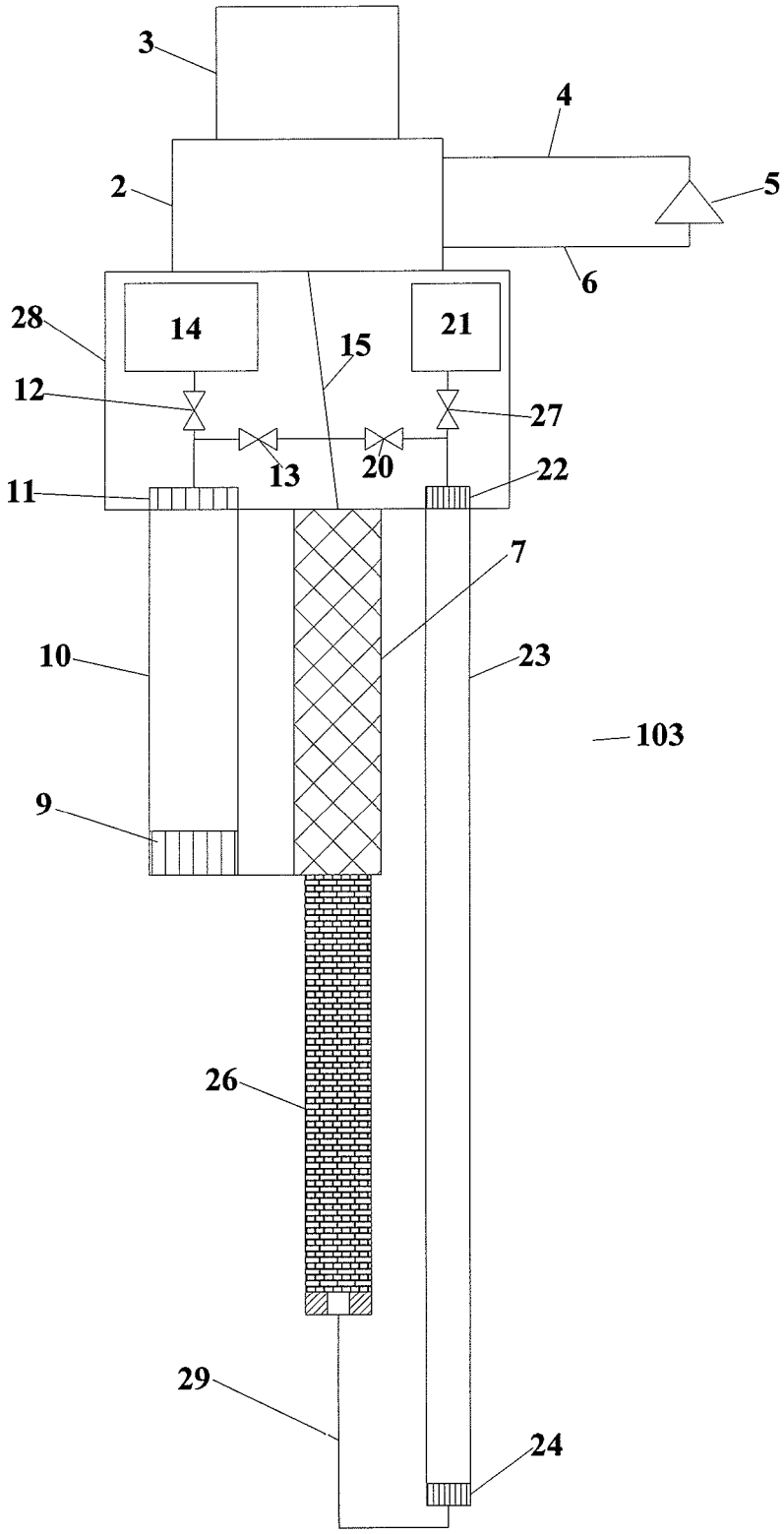
FIG. 5 is a schematic of a two-stage pulse tube in which thermal differences between the pulse tubes and regenerators are reduced by means of a spacer tube at the cold end of the second stage regenerator.

FIG. 5 is a schematic of two stage pulse tube 103 in which thermal differences between second stage pulse tube 23 and regenerator 26 are reduced by means of spacer tube 29 which connects the cold ends of 23 and 26. The length of spacer tube 29 is less than 20% the length of pulse tube 23, preferably between 5% and 20%. This distance is measured between the cold end of regenerator 26 and the top of flow smoother 24.

Figure 6:
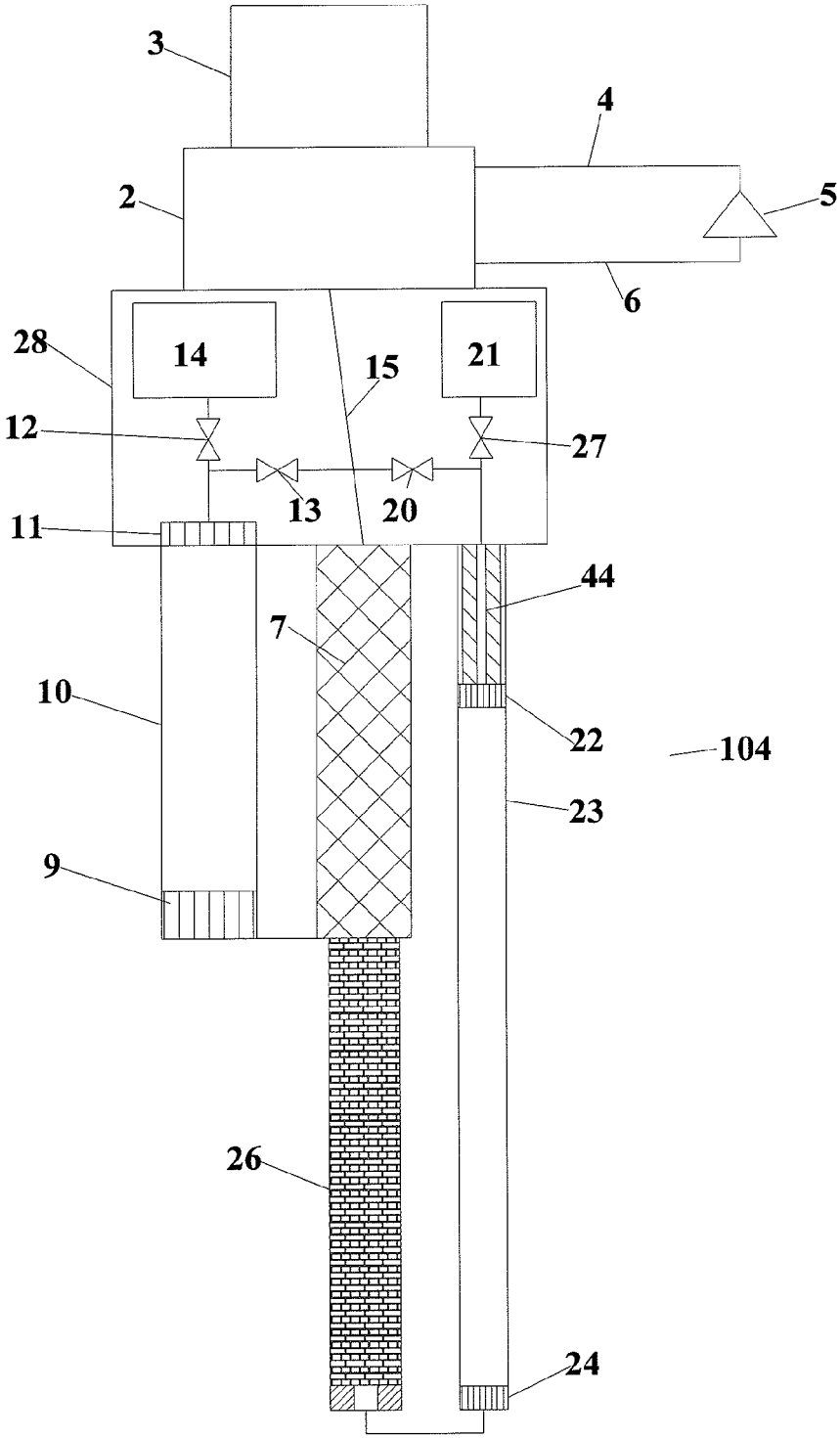
FIG. 6 is a schematic of a two-stage pulse tube in which thermal differences between the pulse tubes and regenerators are reduced by means of a spacer at the warm end of the second stage pulse tube.

FIG. 6 is a schematic of two stage pulse tube 104 in which thermal differences between pulse tube 23 and regenerators 7 and 26, and pulse tube 10, are reduced by means of spacer 44 at the warm end of second stage pulse tube 23. The length of spacer 44 is less than 20% the length of pulse tube 23, preferably between 5% and 20%. This distance is measured between the warm end of regenerator 7 and the bottom of flow smoother 22.

Figure 7:
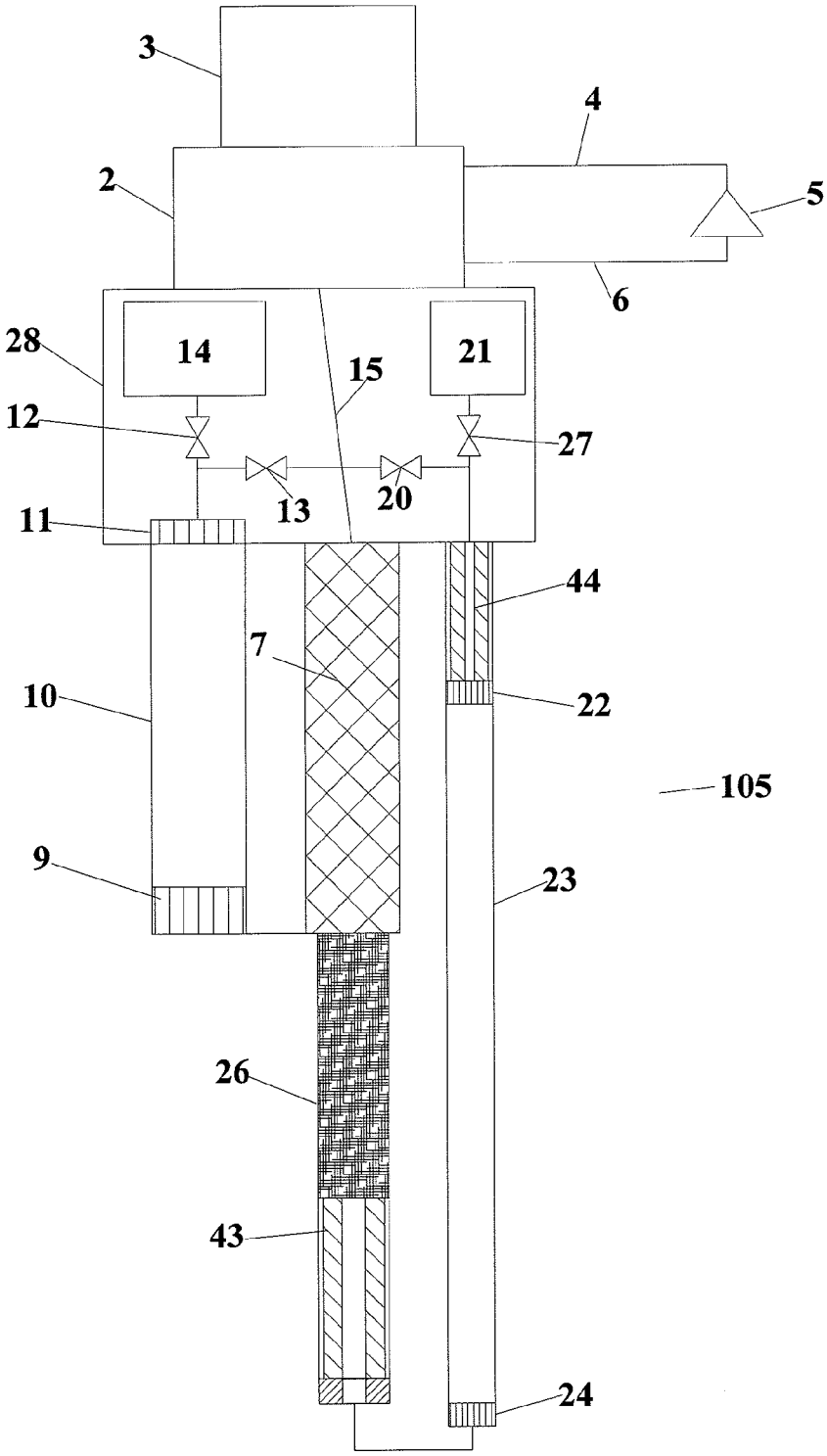
FIG. 7 is a schematic of a two-stage pulse tube in which thermal differences between the pulse tubes and regenerators are reduced by means of spacers at the cold end of the second stage regenerator and the warm end of the second stage pulse tube.

FIG. 7 is a schematic of two stage pulse tube 105 in which thermal differences between the pulse tubes and regenerators are reduced by means of spacer 43 at the cold end of second stage regenerator 26 and spacer 44 at the warm end of second stage pulse tube 23. The length of spacer 44 is less than 20% the length of pulse tube 23. This distance is measured between the warm end of regenerator 7 and the bottom of flow smoother 22. The length of spacer 43 is less than 20% the length of pulse tube 23, preferably between 5% and 20%. This distance is measured between the cold end of regenerator 26 and the top of flow smoother 24. Heat transfer surface in 25 can be augmented by heat transfer surface in spacer 43.

Figure 8:
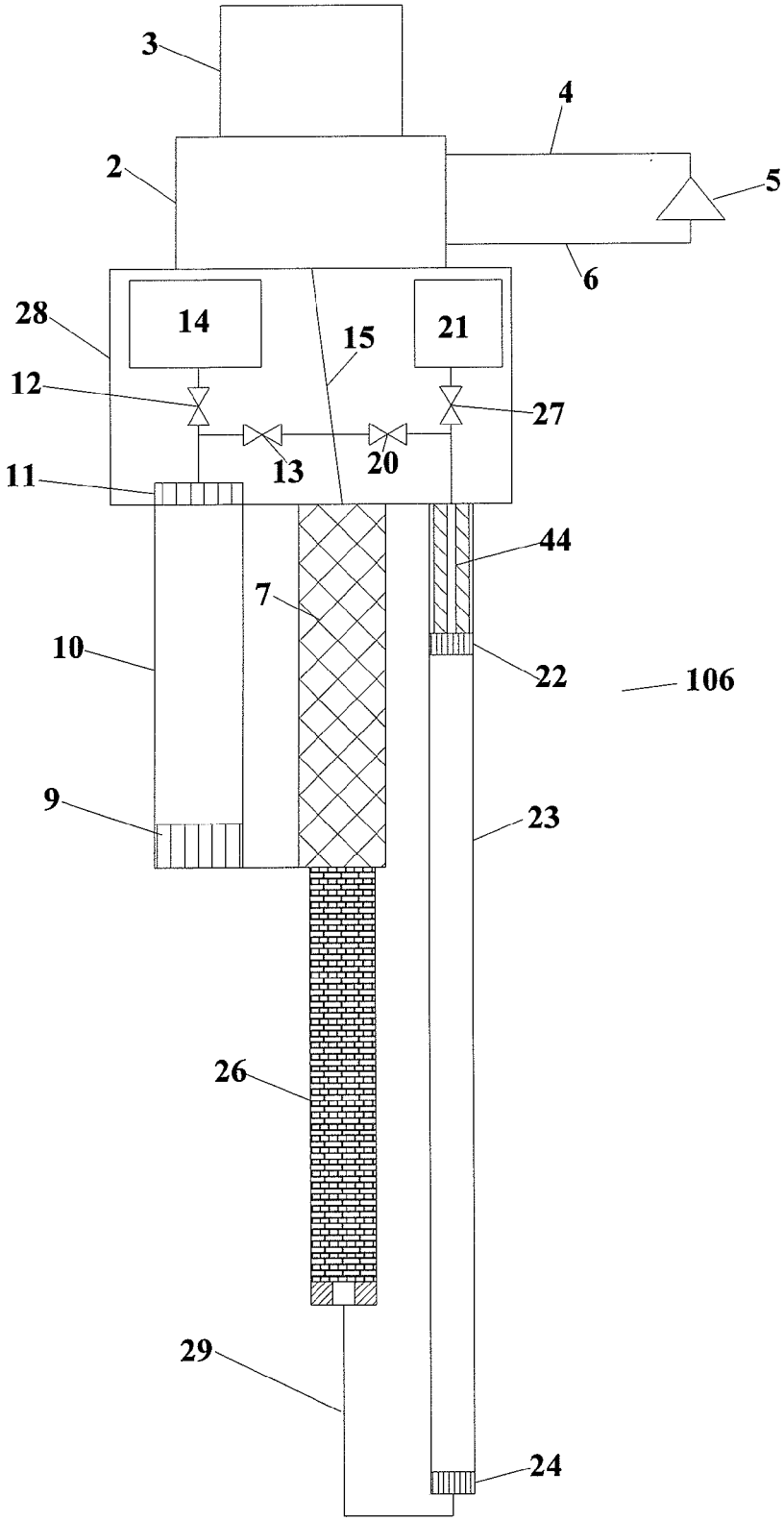
FIG. 8 is a schematic of a two-stage pulse tube in which thermal differences between the pulse tubes and regenerators are reduced by means of a spacer tube at the cold end of the second stage regenerator and a spacer at the warm end of the second stage pulse tube.

FIG. 8 is a schematic of two stage pulse tube 106 in which thermal differences between the pulse tubes and regenerators are reduced by means of spacer tube 29 at the cold end of second stage regenerator 26 and spacer 44 at the warm end of second stage pulse tube 23. The length of spacer 44 is less than 20% the length of pulse tube 23, preferably between 5% and 20%. This distance is measured between the warm end of regenerator 7 and the bottom of flow smoother 22. The length of spacer tube 29 is less than 20% the length of pulse tube 23.

This distance is measured between the cold end of regenerator 26 and the top of flow smoother 24.

Figure 9:
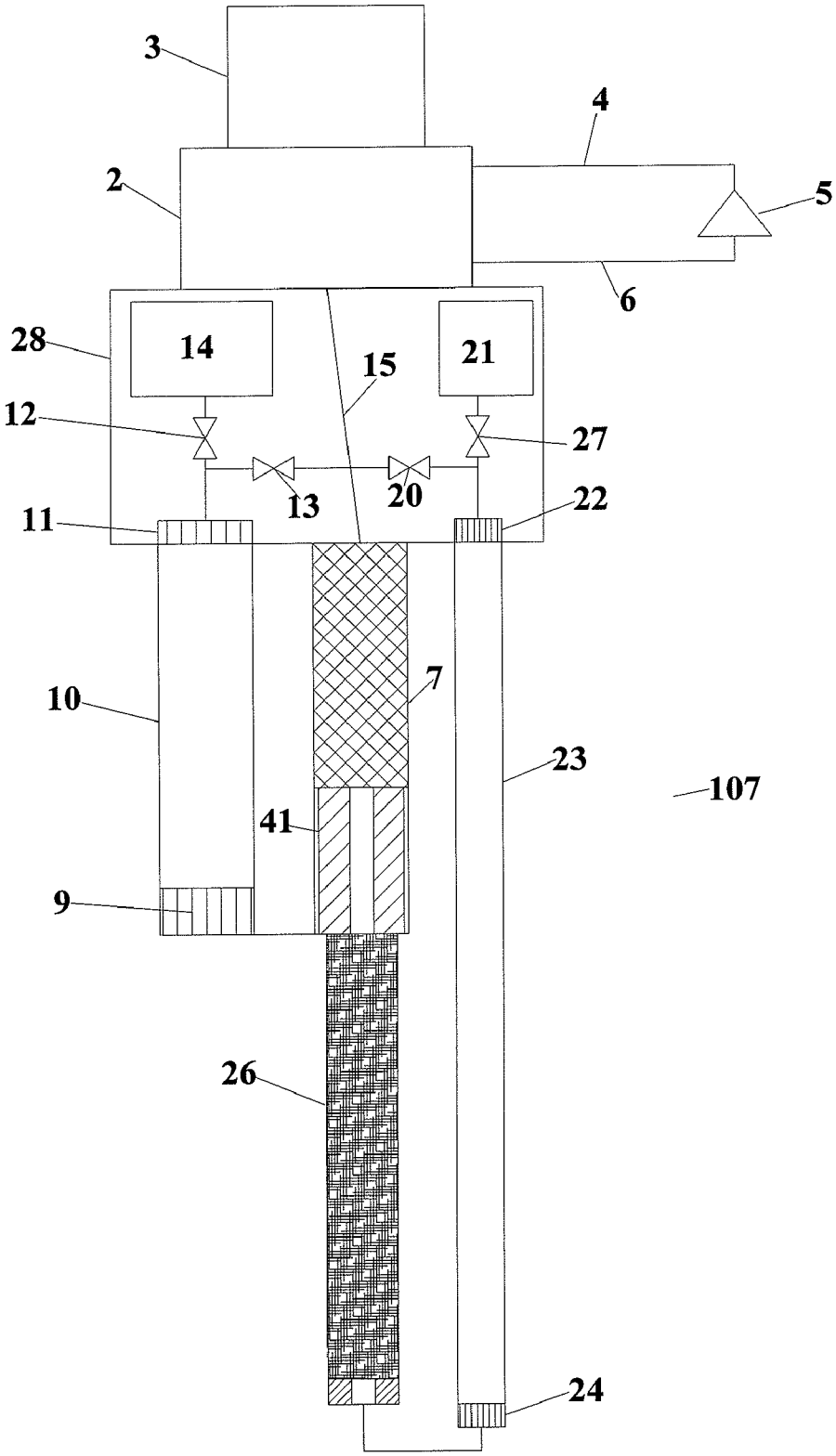
FIG. 9 is a schematic of a two-stage pulse tube in which thermal differences between the pulse tubes and regenerators are reduced by means of a spacer tube at the cold end of the first stage regenerator.

FIG. 9 is a schematic of two stage pulse tube 107 in which thermal differences between the pulse tubes and regenerators are reduced by means of spacer 41 at the cold end of first stage regenerator 7. The length of spacer 41 is less than 20% the length of pulse tube 10, preferably between 5% and 20%. This distance is measured between the cold end of regenerator 7 and the top of flow smoother 9. The heat transfer surface contained in 30 can be augmented in spacer 41.

Figure 10:
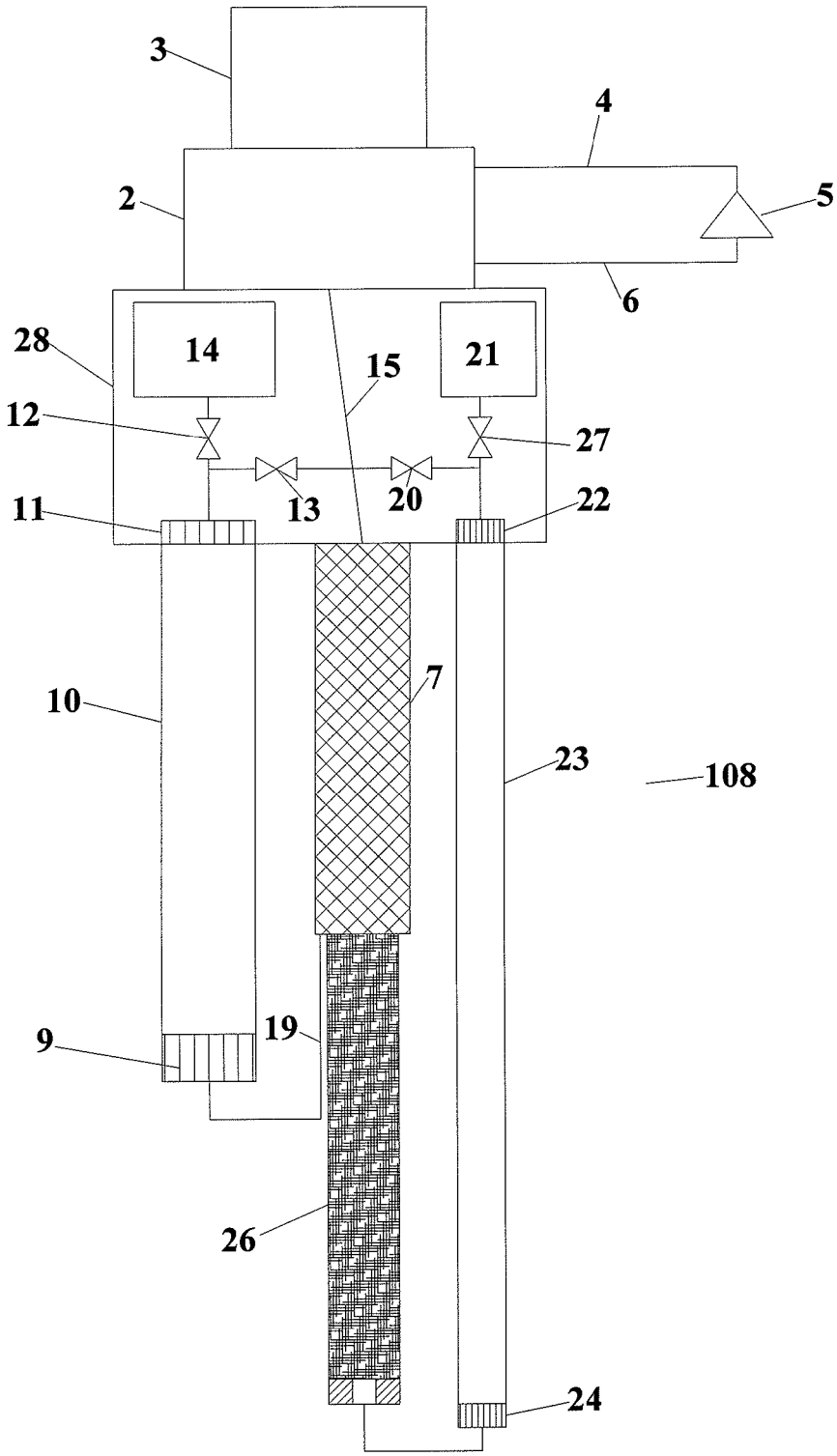
FIG. 10 is a schematic of a two-stage pulse tube in which thermal differences between the pulse tubes and regenerators are reduced by means of a spacer tube connecting the cold end of the first stage regenerator and the first stage pulse tube.

FIG. 10 is a schematic of two stage pulse tube 108 in which thermal differences between the pulse tubes and regenerators are reduced by means of spacer tube 19 which connects the cold end of first stage regenerator 7 and first stage pulse tube 10. The length of spacer tube 19 is less than 20% the length of pulse tube 10, preferably between 5% and 20%. This distance is measured between the cold end of regenerator 7 and the top of flow smoother 9.

Figure 11:
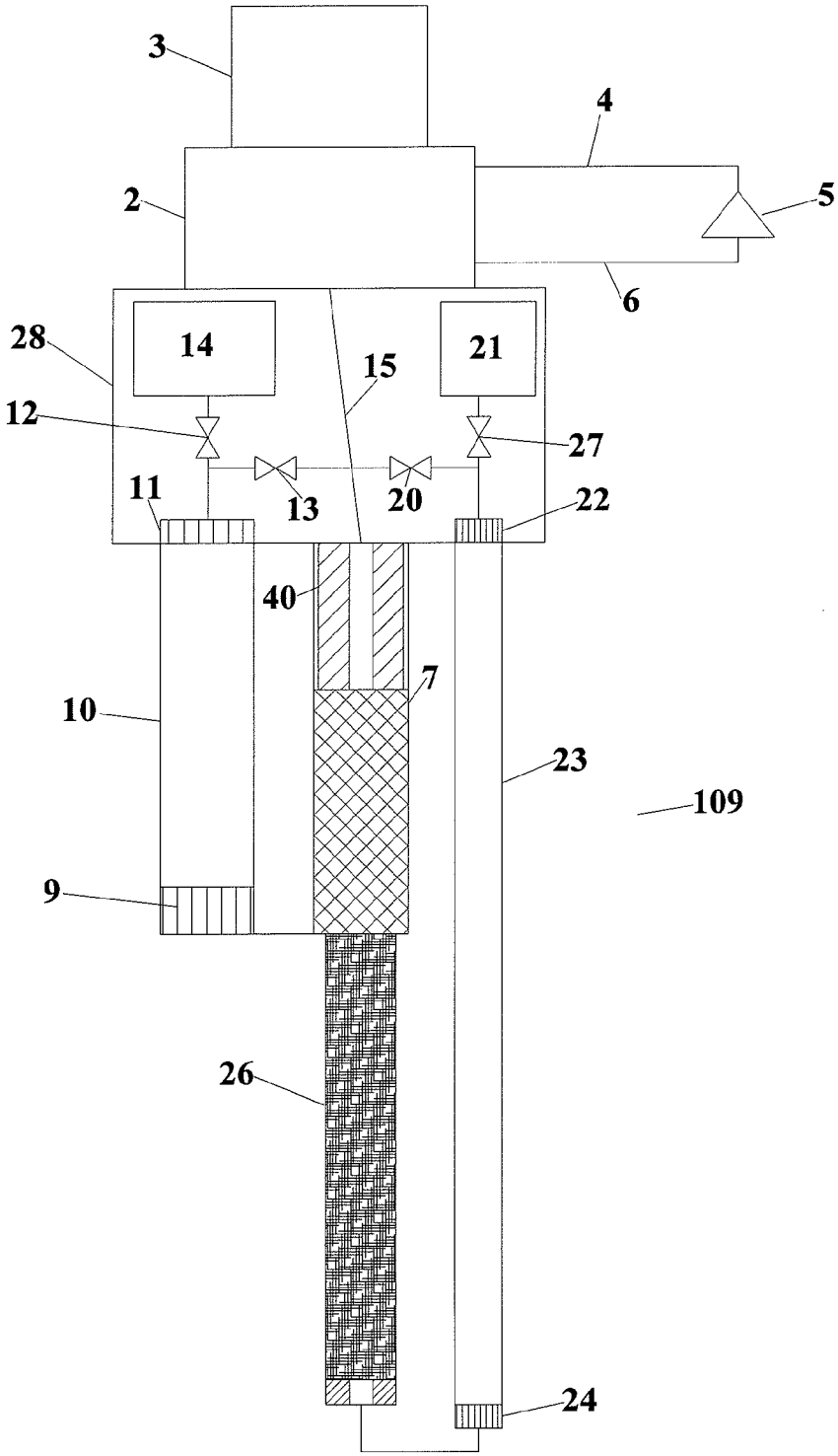
FIG. 11 is a schematic of a two-stage pulse tube in which thermal differences between the pulse tubes and regenerators are reduced by means of a spacer at the warm end of the first stage regenerator.

FIG. 11 is a schematic of two stage pulse tube 109 in which thermal differences between the pulse tubes and regenerators are reduced by means of spacer 40 at the warm end of first stage regenerator 7. The length of spacer 40 is less than 20% the length of pulse tube 10, preferably between 5% and 20%. This distance is measured between the warm end of regenerator 7 and the bottom of flow smoother 11.

Figure 12:
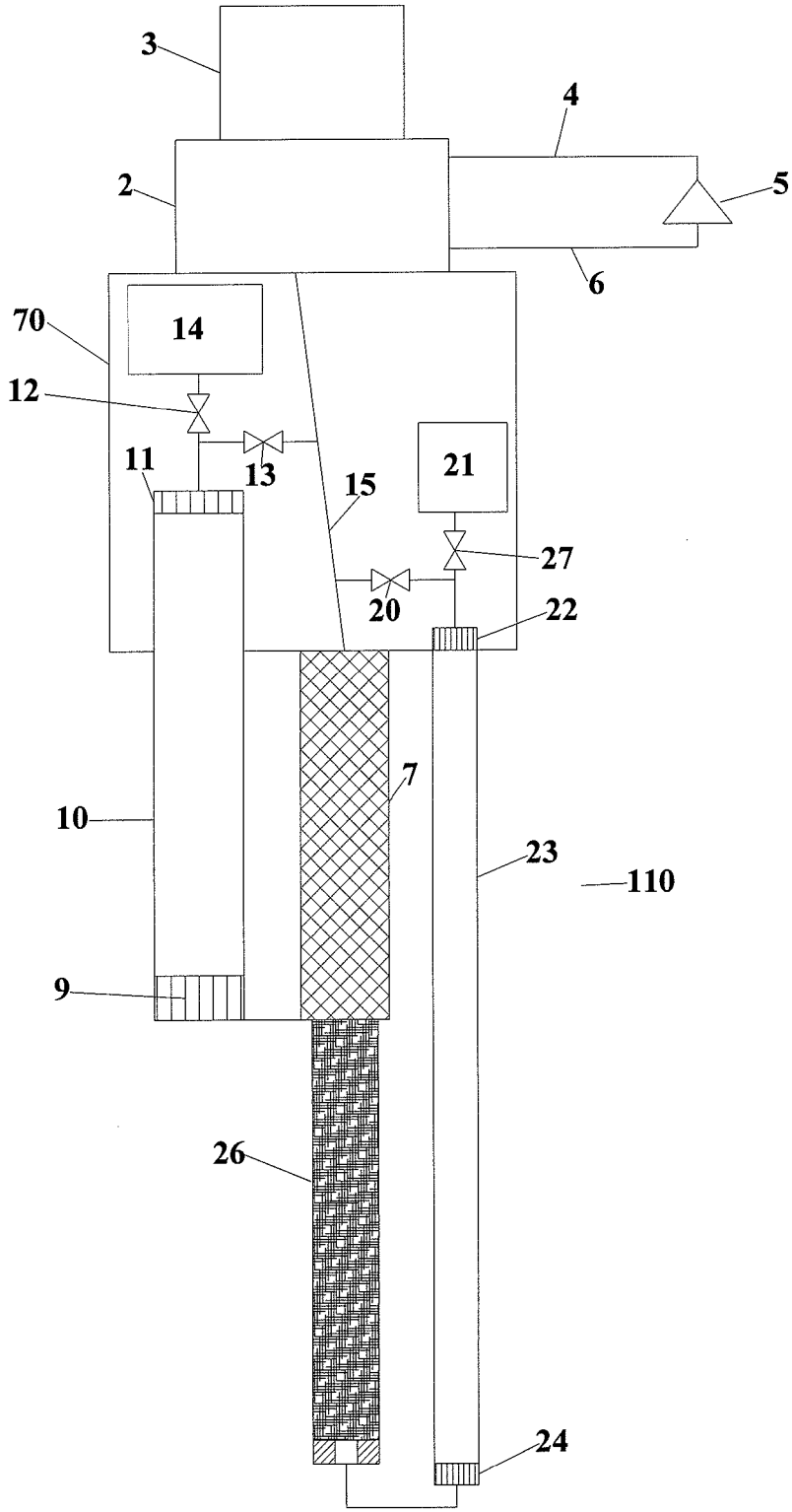
FIG. 12 is a schematic of a two-stage pulse tube in which thermal differences between the pulse tubes and regenerators are reduced by means of extending the warm end of the first stage pulse tube into the warm end manifold body.

FIG. 12 is a schematic of two stage pulse tube 110 in which thermal differences between the pulse tubes and regenerators are reduced by means of extending the warm end of first stage pulse tube 10 into warm end manifold body 70. The length of pulse tube 10 that is in manifold 70 is less than 20% the length of pulse tube 10.

Figure 13:
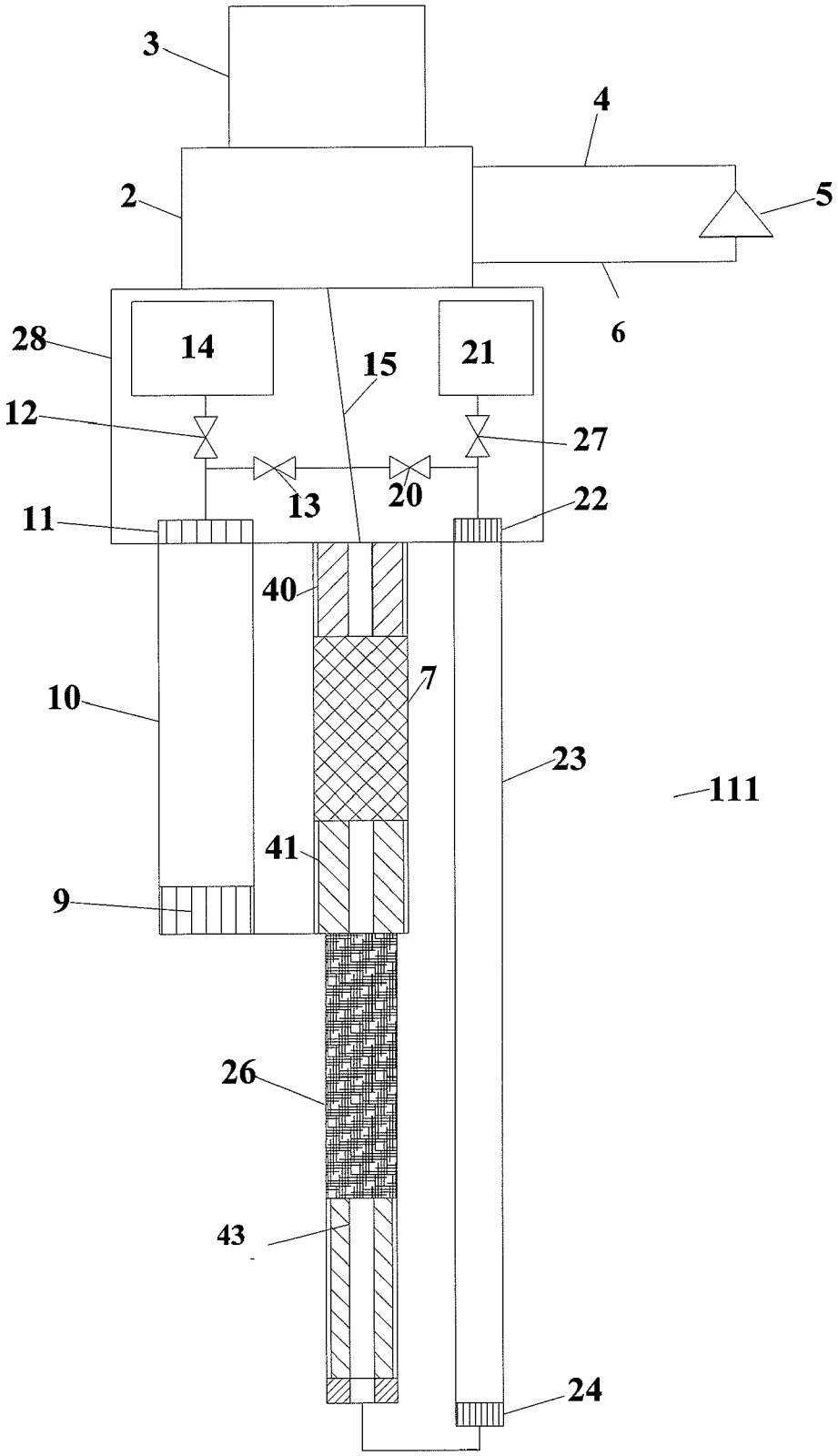
FIG. 13 is a schematic of a two-stage pulse tube in which thermal differences between the pulse tubes and regenerators are reduced by means of spacers at the cold end of the second stage regenerator and at the warm and cold ends of the first stage regenerator.
Figure 14:
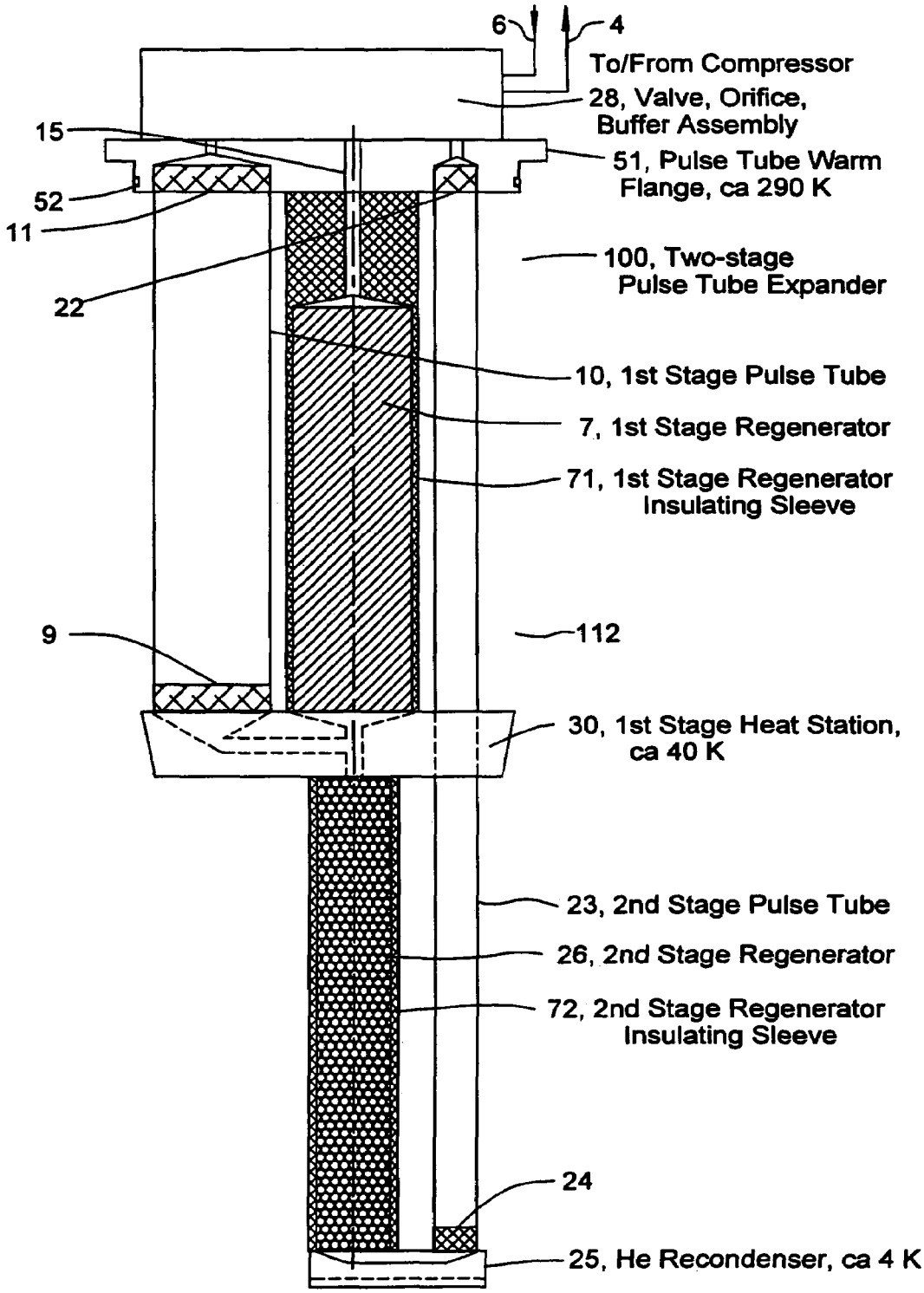
FIG. 14 is a schematic of a two-stage pulse tube in which thermal differences between the pulse tubes and regenerators are reduced by means of insulating sleeves around the first and second stage regenerators.

FIG. 13 is a schematic of two stage pulse tube 111 in which thermal differences between the pulse tubes and regenerators are reduced by means of spacer 40 at the warm end of first stage regenerator 7, spacer 41 at the cold end of 7, and spacer 43 at the cold end of second stage regenerator 26. The length of spacer 40 is less than 20% the length of pulse tube 10, preferably between 5% and 20%. This distance is measured between the warm end of regenerator 7 and the bottom of flow smoother 22. The length of spacer 41 is less than 20% the length of pulse tube 10, preferably between 5% and 20%. This distance is measured between the cold end of regenerator 7 and the top of flow smoother 9. The heat transfer surface contained in 30 can be augmented in spacer 41. The length of spacer 43 is less than 20% the length of pulse tube 23, preferably between 5% and 20%. This distance is measured between the cold end of regenerator 26 and the top of flow smoother 24. Heat transfer surface in 25 can be augmented by heat transfer surface in spacer 43.

FIG. 14 is a schematic of two stage pulse tube 112 in which thermal differences between the pulse tubes and regenerators are reduced by means of insulating sleeve 71 around first stage regenerator 7, and insulating sleeve 72 around second stage regenerator 26. Plastics with cotton, linen, or glass cloth reinforcement are good choices for an insulating sleeve. Glass cloth does not have as low a thermal conductivity as the other fabrics but it has the best dimensional stability and strength.

When designing a multi-stage pulse tube the volumes of the pulse tubes and regenerators are generally set by cooling capacity requirements and compressor displacement. For the pulse tubes there is a lot of latitude in selecting the length to diameter ratios. Length to diameter ratios for the regenerators are more restricted because of the need to balance thermal performance with pressure drop losses. When a pulse tube is designed to be operated in a vacuum, the temperature profiles of the pulse tubes and regenerators are not considered. When operating in a helium environment however they do become an important design consideration. FIGS. 1 and 3 show means to reduce temperature differences between the regenerators and pulse tubes by means of thermal bridges. FIGS. 4 to 13 show means to shift the axial positions of the regenerators relative to the pulse tubes by means of spacers in the regenerators and/or pulse tubes and by means of spacer tubes between the cold ends of the regenerators and the cold ends of the pulse tubes. FIG. 14 shows the option of packing the regenerators in insulating sleeves.

The different means of reducing the temperature differences between the regenerators and pulse tubes that have been described can be used individually or in combination, with pulse tubes that have one or more stages.

The invention claimed is:

1. A GM type pulse tube refrigerator mounted in a non-vacuum atmosphere and having a reduced temperature differential between the pulse tubes and the regenerators in the refrigerator comprising:

a pulse tube assembly and one or more heat transfer reducing components selected from the group consisting of thermal bridges, spacers, spacer tubes and insulating sleeves and combinations thereof placed between the pulse tubes and regenerators;

wherein at least one of spacers and spacer tubes is provided at the cold end of at least one of the regenerators;

said spacers and spacer tubes being 5% to 20% the length of the associated pulse tube.

2. The refrigerator of claim 1 where the pulse tube assembly is mounted in a cryostat.

3. The refrigerator of claim 1 which has multi-stages.

4. The refrigerator of claim 3 where the pulse tube assembly is mounted in the neck tube of a MRI cryostat.

5. The refrigerator of claim 4 where the pulse tube assembly is removable from the neck of the cryostat.

6. The refrigerator of claim 1 where the heat transfer reducing components include thermal bridges.

7. The refrigerator of claim 1 where the heat transfer reducing components include one or more warm spacers.

8. The refrigerator of claim 7 where the spacers are in the range of from 5% to 20% of the length of the associated pulse tube.

9. The refrigerator of claim 1 where one or more spacers contain a heat transfer surface.

10. The refrigerator of claim 1 where the heat transfer reducing components are insulating sleeves.

11. The refrigerator of claim 1 where the non-vacuum atmosphere is one of a helium, hydrogen, and neon atmosphere.

12. The refrigerator of claim 11 where the non-vacuum atmosphere is one of a hydrogen and neon atmosphere.

13. The refrigerator of claim 11 where the non-vacuum atmosphere is a helium atmosphere.

14. The refrigerator of claim 4 where the heat transfer reducing components include thermal bridges.

15. The refrigerator of claim 4 where the heat transfer reducing components are one or more warm spacers.

16. The refrigerator of claim 15 where the spacers are in the range of from 5% to 20% of the length of the associated pulse tube.

17. The refrigerator of claim 4 where one or more spacers contain a heat transfer surface.

18. The refrigerator of claim 4 where the heat transfer reducing components are insulating sleeves.

19. The refrigerator of claim 4 where the non-vacuum atmosphere is one of a helium, hydrogen, and neon atmosphere.

20. The refrigerator of claim 19 where the non-vacuum atmosphere is one of a hydrogen and neon atmosphere.

21. The refrigerator of claim 19 where the non-vacuum atmosphere is a helium atmosphere.

22. The refrigerator of claim 1, wherein the refrigerator includes at least more than two thermal bridges.

* * * * *